United States Patent [19]

Beaman

[11] 3,948,391

[45] Apr. 6, 1976

[54] HOLDERS FOR NEEDLES AND LIKE ARTICLES

[75] Inventor: Roger John Beaman, Evesham, England

[73] Assignee: Needle Industries Limited, Birmingham, England

[22] Filed: May 8, 1974

[21] Appl. No.: 467,867

[30] Foreign Application Priority Data

Nov. 1, 1973 United Kingdom..... 52965/73

[52] U.S. Cl...... 206/382; 206/461

[51] Int. Cl.[2]..... B65D 85/28

[58] Field of Search ..... 206/382, 484, 388, 486, 206/461

[56] References Cited

UNITED STATES PATENTS 3,338,400 8/1967 Edgworth et al. ..... 206/484

3,696,920 10/1972 Lahay ..... 206/484

FOREIGN PATENTS OR APPLICATIONS 770,469 3/1957 United Kingdom..... 206/382

*Primary Examiner*—William Price
*Assistant Examiner*—Douglas B. Farrow
*Attorney, Agent, or Firm*—Kurt Kelman

[57] ABSTRACT

A holder for needles comprises a card base having a cover in the form of a transparent plastics shell secured thereto along one edge. Needles may be held either in a corrugation formed in the material of the base, or on a mounting member which has an edge secured between the base and the edge of the cover.

1 Claim, 3 Drawing Figures

121
120
119
114
112
120
110
117
111
220
219
218
216
219
213
211
223
221
210
224
216
225
222

226

117
217
116
212
114
214
115
110
111
114a
118

HOLDERS FOR NEEDLES AND LIKE ARTICLES

BACKGROUND OF THE INVENTION

1. Field Of The Invention

This invention relates to holders for elongated articles having stem or shank-like portions such as needles, especially sewing needles, and like articles of comparable dimensions and weight, including ordinary headed pins, safety pins, and hair pins or grips, all of which are of light weight and small dimensions and are generally required to be stored and protected prior to sale to user, displayed for sale purposes, and stored by the user after sale between periods of use. Such articles are hereinafter referred to as articles of the kind specified.

2. Description Of The Prior Art

One form of holder in which, in the past, sewing needles have been packaged for sale comprises a wrapping member made of a thin sheet material such as paper, and a mounting element attached to the wrapping member including a piece of cloth or similar material to which the needles are attached by passing them through a mid portion of such piece of material.

More recently, a construction has been proposed in which a mounting member comprising a moulding of thermoplastic material is attached to a base member, the mounting member being provided with gripping formations for needles and there being a cover member in the form of a hollow transparent plastics shell which protects the needles held by the mounting member whilst permitting them to remain visible. Such a needle holder is disclosed in U.S. Pat. No. 3,500,998.

Whilst this last mentioned construction provides a very strong package for needles it has disadvantages in that it is relatively expensive to manufacture and requires complex machinery for the moulding and attachment of the mounting member to the base.

SUMMARY OF THE INVENTION

It is the object of the present invention to provide a holder for needles or other articles of the kind specified which is improved in respect of the above mentioned difficulties or disadvantages, and in which a separate manufacturing operation for the attachment of a needle mounting member to another part of the holder is not necessary.

According to one aspect of the invention a holder for articles of the kind specified comprises a substantially flat base member, a mounting member adapted to hold one or more of said articles in assembled relation with the base member by engagement with the stem or shank-like portion of the or each such article, and a cover member formed as a hollow shell of a shape holding transparent plastic material presenting an open side towards the base member, the base member and the cover member being relatively movable between a closed position in which any of said articles held by the mounting member is disposed within said hollow shell and an open position in which any of said articles held by the mounting member is disposed substantially externally of said hollow shell, the mounting member comprising a piece of sheet material having an edge portion secured between the base member and a marginal part of the cover member. Such securement of the mounting member may thus be effected in a single operation as the cover member is secured to the base.

The mounting member preferably comprises a composite paper backed cloth material, and is provided with a corrugation or corrugations through which the shanks of the articles to be held are passed.

The cover member may be shaped to provide a first portion raised from the plane of the margins of the cover member, and the further portion raised from said plane by a greater distance, the mounting member for the articles being disposed within the further raised portion. The one raised portion of the cover member then provides a convenient location in which, for example, printed instructions or advertising matter may be displayed, which remains protected by the cover member when it is in its closed position. The mounting member and articles are then accommodated by the further raised portion.

According to another aspect of the invention, a holder for articles of the kind specified comprises a generally flat base member including a portion raised out of the plane of the remainder of the base member, said raised portion being adapted to hold one or more of said articles in assembled relation with the base member, and a cover member formed of a hollow shell of a shape-holding transparent plastics material presenting an open side towards the base member, the base member and cover member being relatively movable between a closed position in which any of said articles held on said raised portion of the base member is disposed within said hollow shell and an open position in which any of said articles held by said raised portion of the base member is disposed substantially externally of said hollow shell.

Said raised portion preferably comprises a corrugation provided by the displacement of end portions of the base member relatively towards one another. In order that marginal portions of the base member remain flat so as to be engageable with margins of the cover member, the marginal portions adjacent a corrugation forming part of the base member are removed in a manner such that when the corrugation is formed no substantial gap is left between adjacent parts of the margins.

Since the mounting for the needles comprises an integral part of the base member, there is no need for a separate manufacturing operation to secure a mounting member to the base.

By "shape holding" we mean that the material is sufficiently stiff to retain its shape during normal conditions of usage.

DESCRIPTION OF THE PREFERRED EMBODIMENT

Figures 1, 2, 3:
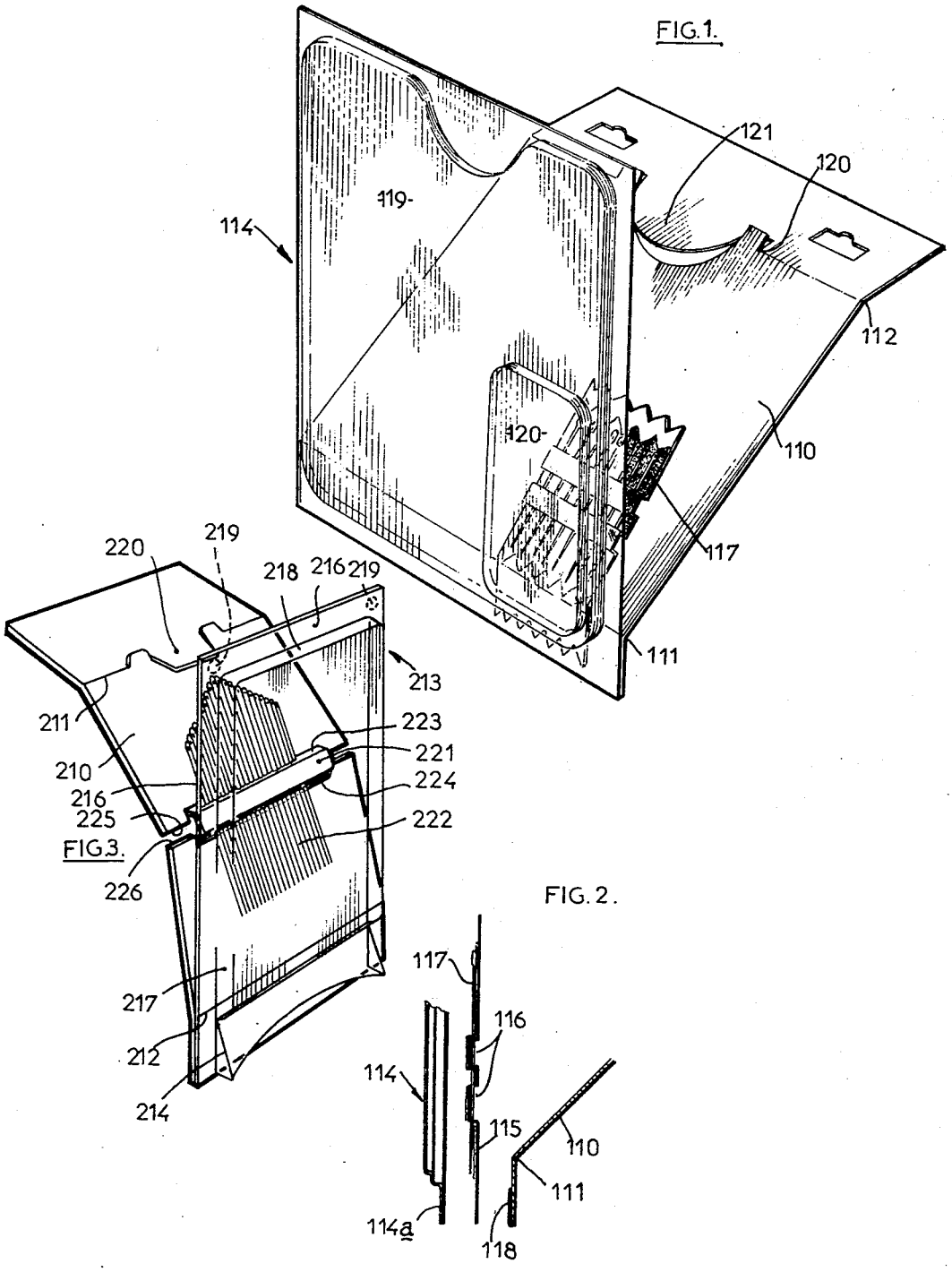
FIG. 1 is a perspective view of one embodiment of a holder for needles, in accordance with the invention, with the cover in an open position.
FIG. 2 is an exploded side elevation of part of the holder of FIG. 1.
FIG. 3 is a perspective view of another embodiment of holder for needles, with the cover in an open position.

The needle holder illustrated in FIGS. 1 and 2 comprises a card 110 constituting a base member, creased or scored at 111, 112, to enable it to be bent to the conformation of FIG. 1. A rigid transparent plastics cover member 114 in the form of a hollow shell having margins 114*a* 114*b* 114*c* 114*d* is attached to card 110 by its lower margins 114*a*, securement being effected by means of a suitable heat sensitive adhesive layer

118.

Between the margin 114*a* of the cover member and the card 110 is secured one end of a mounting member 115. The mounting member 115 of a paper backed cloth material, is corrugated at 116, the needles 117 having their shanks pushed through the corrugations to secure them to the mounting member.

The cover member 114 has two portions raised from the plane of its margins as 114*a*, namely a first portion 119 and a further portion 120. The portion 120 is raised by a greater distance than the portion 119, to accommodate the mounted needles, while, for example, an instruction sheet or other similar matter may be accommodated by portion 119.

The card base member 110 is perforated at 121 to define a tongue 122, beneath which the free end of the cover member may be engaged in order to secure it to the card at its end remote from that at which it is held by adhesive. Repeated opening and closing of the cover member is thus possible. Before the holder is opened for the first time, the end of the cover member would normally be secured to the card by means of a small quantity of a suitable adhesive which is readily rupturable by the user.

Since the mounting member of the holder described is secured between the margin of the cover member and the base member, assembly of the holder is easily carried out as a single manufacturing operation, thus reducing the cost of manufacture thereof. Further, articles in addition to the needles may be accommodated within and protected by the cover member, and yet remain visibly displayed.

Referring now to FIG. 3 of the drawings, the needle holder there illustrated comprises a card base member 210, creased or scored at 211, 212, to enable it to be bent to a configuration as shown in FIG. 6. A rigid transparent plastics cover member 213 in the form of a hollow shell is attached to the base member 210 adjacent one end thereof by means of a suitable heat sensitive adhesive applied in the region 214.

The cover member 213 is of generally rectangular shape, and is formed with a raised portion 215 which is raised from the plane of marginal portions 216 of the cover member by inclined lateral and end faces 217, 218 respectively. Initially, the end marginal portion 216 of the cover member is secured to the base member by two small areas 219 of heat sensitive adhesive, the seal afforded by these areas being readily rupturable when the holder is to be opened.

The base member is provided in the region of the crease or score line 211 with a tongue 220, beneath which the marginal portion 216 adjacent end face 217 of the cover member may be received when it is desired to hold the cover member in the closed position after the initial opening thereof.

Approximately medially between the crease or score lines 211, 212, the base member is provided with a portion 221 in the form of a corrugation, raised out of the plane of the remainder of the base member to provide a mounting for needles 222. When in position, the needles 222 extend through opposed end walls 223, 224 of the corrugation 221 for retention.

To form the corrugation 221, opposite end portions of the base member must be displaced relatively towards one another, and in order that the side marginal portions of the cover member lie in a flat face to face relationship with the margins of the base member, the margins of the base member in the region adjacent the corrugation forming part thereof are cut out in a manner such that when the corrugation is formed no substantial gap is left between adjacent parts 225, 226 of the margin.

As a consequence of the provision of the corrugation 221 for mounting the needles, the base member is readily capable of being bent along a line in the general region of the corrugation and the gap between adjacent margins, thus facilitating removal of needles from the holder when the cover member is in its open position.

By shape holding we mean that the material of the cover member is sufficiently stiff to retain its shape during normal conditions of use.

I claim:

1. A holder for articles of the kind specified, comprising a base member, a mounting member for holding one or more such articles in assembled relation with the base member by engagement with the stem or shank-like portion of such article, and a cover member comprising a hollow shell of a shape holding transparent plastics material presenting an open side towards the base member, the cover member having a marginal portion secured to the base member and the shell being relatively movable between a closed position in which any of said articles held by the mounting are disposed within said hollow shell and in which the base member is generally flat, and an open position in which any of said articles held by the mounting member are disposed substantially externally of said hollow shell, the mounting member comprising a corrugation of the material of the base member displaced out of the general plane of the base member, marginal parts of the base member adjacent the corrugation being provided with cut-out portions for permitting such marginal parts to remain generally flat.

* * * * *